US005317815A

United States Patent [19]

Hwang

[11] Patent Number: 5,317,815

[45] Date of Patent: Jun. 7, 1994

[54] GRILLE ASSEMBLY FOR HAIR DRIERS

[76] Inventor: Shyh-Jye Hwang, 5/F., No. 2, Lane 81, Sec. 2, Min-Chuan St., Hsi-Chih Town, Taipei Hsien, Taiwan

[21] Appl. No.: 76,858

[22] Filed: Jun. 15, 1993

[51] Int. Cl.[5] ..... A45D 20/00

[52] U.S. Cl. ..... 34/97; 392/380

[58] Field of Search ..... 34/97, 96, 91, 90; 392/380, 397, 383, 373; 239/383

[56] References Cited

U.S. PATENT DOCUMENTS 4,295,283 10/1981 Tomaro ..... 34/97

5,161,317 11/1992 McDougall ..... 34/97

*Primary Examiner*—Henry A. Bennet

*Attorney, Agent, or Firm*—Morton J. Rosenberg; David I. Klein

[57] ABSTRACT

A grille assembly including a hopper-like barrel connector having a smaller rear connecting tube fastened around the barrel of a hair dryer and a bigger front rounded shell, a grille covered on the front opening of the rounded shell, the grille having a center shaft disposed inside the rounded shell, and a rotary vane mounted on the center shaft of the grille, whereby the rotary vane is rotated to induce outside air into the rounded shell through through holes thereon for mixing with the current of hot air being produced by the hair drier.

1 Claim, 3 Drawing Sheets

GRILLE ASSEMBLY FOR HAIR DRIERS

BACKGROUND OF THE INVENTION

The present invention relates to a grille assembly for mounting on the barrel of a hair drier to broaden the output port of the hair drier.

The output terminal of a hair drier is generally made in the shape of a barrel for guiding the output current of air. Because the barrel is narrow, the output current of air is strong and greatly concentrated, therefore high noises will be produced during the operation of a hair drier. Because the current of air is highly concentrated, a relatively longer time is needed to dry the hairs. Furthermore, the hairs may be damaged easily when dried by a highly concentrated current of hot air.

SUMMARY OF THE INVENTION

It is one object of the present invention to provide a grille assembly for a hair drier which induces outside air to mix with the current of hot air being produced by the hair drier so as not to damage the hairs. It is another object of the present invention to provide a grille assembly for a hair drier which greatly increase the output port of the hair drier. It is still another object of the present invention is to provide a grille assembly for a hair drier which reduces the noises of the hair drier during its operation. It is still another object of the present invention to provide a grille assembly for a hair drier which greatly improves the efficiency of the hair drier.

DETAILED DESCRIPTION OF THE PREFERRED EMBODIMENT

Figure 1:
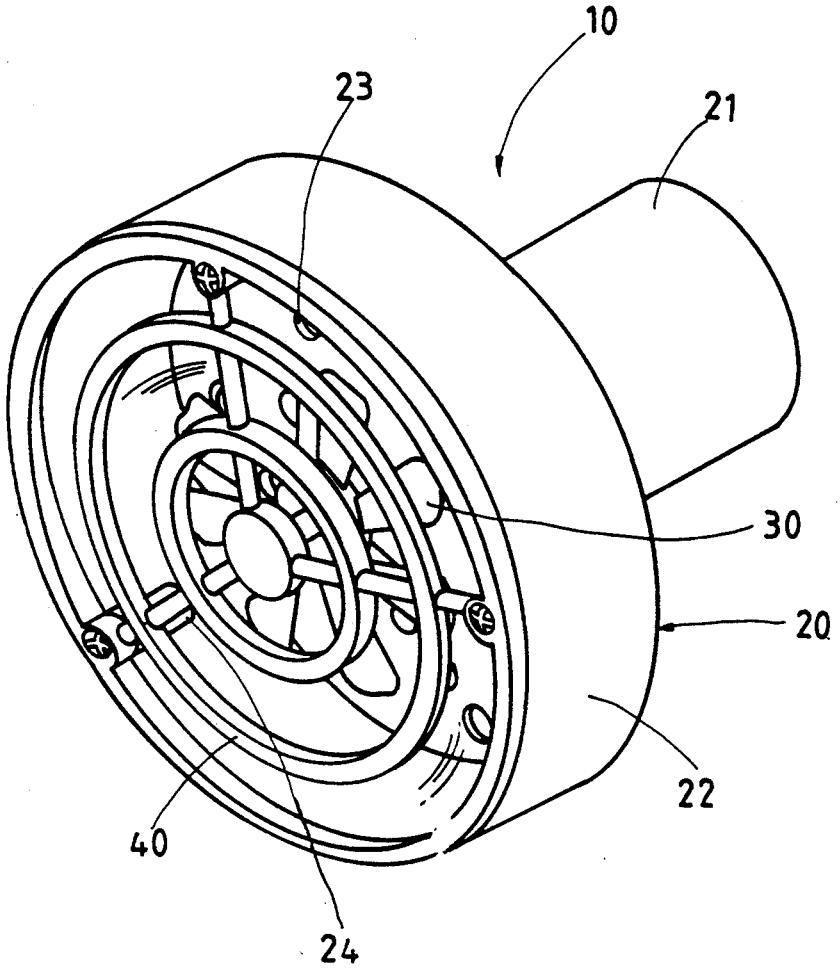
FIG. 1 is a perspective view of a grille assembly according to the preferred embodiment of the present invention.
Figure 2:
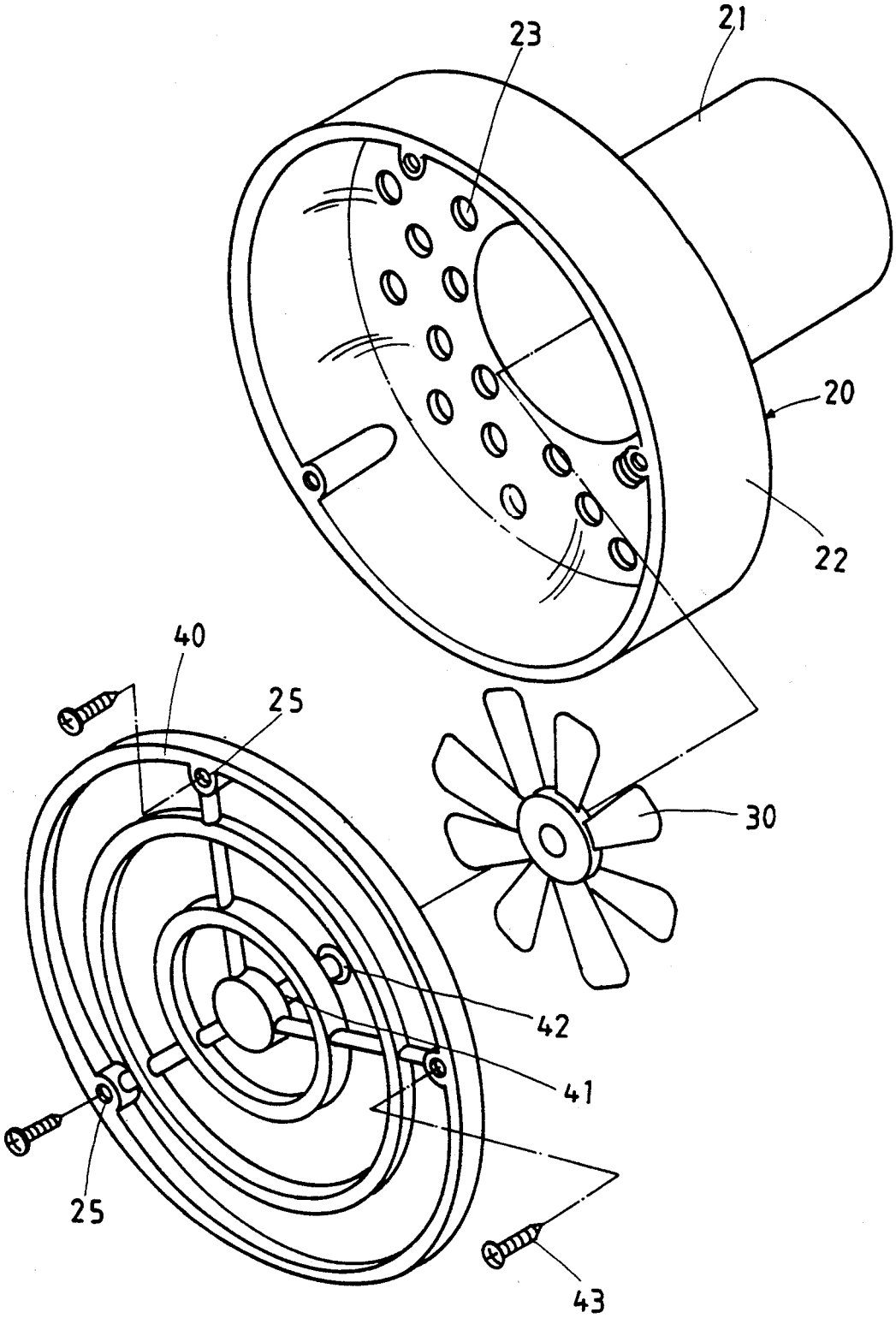
FIG. 2 is an exploded view of the grille assembly shown in FIG. 1.

Referring to FIGS. 1 and 2, a grille assembly 10 in accordance with the preferred embodiment of the present invention is generally comprised of a barrel connector housing 20, a rotary vane 30, and a grille 40. The barrel connector housing 20 is made in the shape of a hopper, having a bigger front end terminated to a rounded shell 22 for holding the rotary vane 30, and a smaller rear end terminated to a connecting tube 21 for fastening to a hair drier around the outlet of the barrel of the housing thereof. The rounded shell 22 has a plurality of through holes 23 over the back wall thereof (the connecting tube 21 extends from the center of the back wall of the rounded shell 22), and a plurality of elongated projections 24 spaced around the inside wall thereof, each elongated projection 24 having a screw hole 25. The grille 40 is covered on the rounded shell 22 and fastened to the screw holes 25 on the elongated projections 24 by screws 43, having a center shaft 41 at one side inserted through the center through hole 31 on the rotary vane 30 to hold the rotary vane 30 inside the rounded shell 22. An end cap 42 is fastened around the center shaft 41 of the grille 40 to retain the rotary vane 30 in place.

Figure 3:
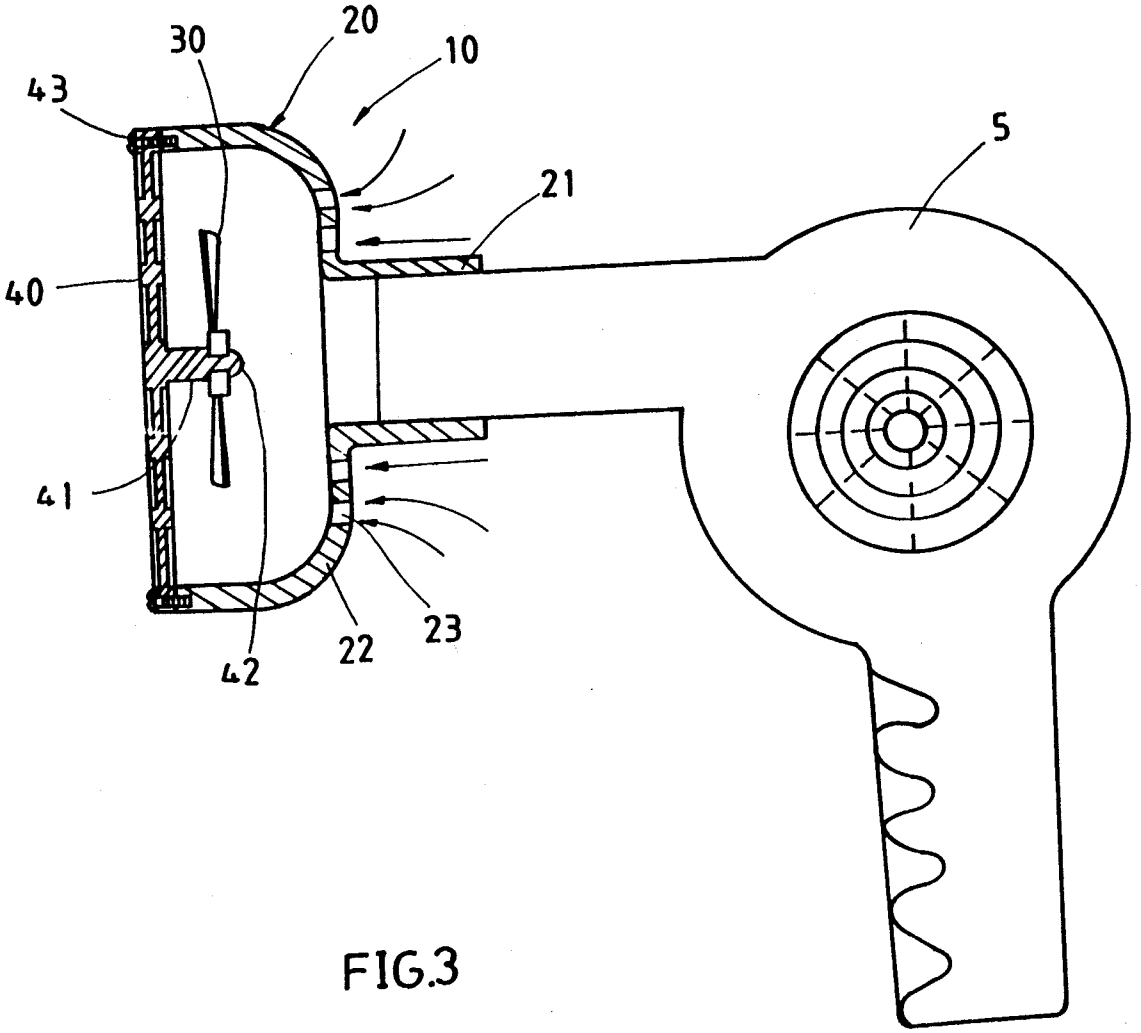
FIG. 3 is a sectional view showing the grille assembly fastened to the barrel of a hair drier.

Referring to FIG. 3, therein illustrated is a sectional view showing the grille assembly fastened to a hair dryer 5. As the hair dryer 5 is turned on to blow a current of hot air through the grille assembly via the barrel of the housing thereof, the rotary vane 30 is caused to rotate, and outside air is induced into the rounded shell 22 through the through holes 23 to mix with the current of hot air from the hair dryer 5, and therefore a current of warm air is blowing through the grille 40. Because the diameter of the rounded shell 22 is much bigger than that of the barrel of the hair drier 5, a broader heating area is achieved.

While only one embodiment of the present invention has been shown and described, it will be understood that various modifications and changes could be made without departing from the spirit and scope of the invention.

What is claimed is:

1. A grille assembly for attachment to a hair dryer having a heated air output section comprising:

(a) a barrel connector housing defining an open internal chamber for flow of air therethrough, said barrel connector housing having a frontal open section and a rear section forming a back wall of said barrel connector housing;

(b) a connecting tube secured to and extending from said back wall of said barrel connector housing back wall for coupling to said heated air output section of said hair dryer, said connecting tube having a through passage in fluid communication with said open internal chamber of said barrel connector housing;

(c) a grille secured to a sidewall of said barrel connector housing and located at said frontal section of said barrel connector housing, said grille having a grille center shaft extending internal said open chamber; and, (d) a rotary vane rotatably mounted on said grille center shaft, said back wall of said barrel connector housing having a plurality of back wall openings formed therethrough whereby heated air from said hair dryer rotatably displaces said rotary vane inducing external air to be drawn into said open internal chamber through said back wall openings for mixing with said heated air and passage through said frontal open section of said barrel connector housing.

* * * * *